US009922631B2

(12) United States Patent
Rajendran et al.

(10) Patent No.: US 9,922,631 B2
(45) Date of Patent: Mar. 20, 2018

(54) CAR KARAOKE

(71) Applicant: Panasonic Automotive Systems Company of America, Division of Panasonic Corporation of North America, Peachtree City, GA (US)

(72) Inventors: Shantha Kumari Rajendran, Farmington Hills, MI (US); Padmanaban Kanagaraj, Farmington Hills, MI (US)

(73) Assignee: Panasonic Automotive Systems Company of America, a division of Panasonic Corporation of North America, Peachtree City, GA (US)

( * ) Notice: Subject to any disclaimer, the term of this patent is extended or adjusted under 35 U.S.C. 154(b) by 0 days.

(21) Appl. No.: 15/622,234

(22) Filed: Jun. 14, 2017

(65) Prior Publication Data

US 2017/0372686 A1 Dec. 28, 2017

Related U.S. Application Data

(60) Provisional application No. 62/354,643, filed on Jun. 24, 2016.

(51) Int. Cl.
*G10H 1/36* (2006.01)
*G10L 25/48* (2013.01)

(52) U.S. Cl.
CPC ..... *G10H 1/361* (2013.01); *G10L 25/48* (2013.01); *G10H 2240/211* (2013.01)

(58) Field of Classification Search
CPC ..... G10H 1/361; G10H 2240/211
USPC ..... 84/610
See application file for complete search history.

(56) References Cited

U.S. PATENT DOCUMENTS

D364,617 S * 11/1995 Fitzgerald ..... D14/142
5,518,408 A * 5/1996 Kawashima ..... G09B 15/00 434/307 A
5,542,000 A * 7/1996 Semba ..... G10H 1/363 381/61
5,654,516 A * 8/1997 Tashiro ..... G10H 1/20 84/601
5,885,085 A * 3/1999 Fujita ..... G10H 1/365 340/901
6,025,553 A * 2/2000 Lee ..... G10H 1/365 84/602
6,114,774 A * 9/2000 Fiegura ..... G10H 1/361 307/9.1
7,899,398 B2 * 3/2011 Lee ..... G10H 1/0083 370/328

(Continued)

*Primary Examiner* — David Warren
(74) *Attorney, Agent, or Firm* — Laurence S. Roach, Esq.

(57) ABSTRACT

A motor vehicle includes a loudspeaker, a voice recognition module, and a microphone producing a microphone signal based upon words uttered by a human passenger within a passenger compartment of the motor vehicle. An electronic processor is communicatively coupled to the microphone, the loudspeaker, and the voice recognition module. The electronic processor receives the microphone signal and communicates with the voice recognition module to thereby ascertain the words uttered by the human passenger. The electronic processor retrieves Karaoke music corresponding to the ascertained words uttered by the human passenger, and plays the Karaoke music on the loudspeaker.

14 Claims, 2 Drawing Sheets

(56) References Cited

U.S. PATENT DOCUMENTS

| | | | | |
|---|---|---|---|---|
| 8,873,722 | B2 * | 10/2014 | Yoshida | B60R 11/0241 379/100.02 |
| 8,892,565 | B2 * | 11/2014 | Xu | G06F 17/30017 704/207 |
| 9,076,421 | B1 * | 7/2015 | Munoz | G10H 1/361 |
| 2004/0116069 | A1 * | 6/2004 | Fadavi-Ardekani | H04H 40/90 455/3.02 |
| 2005/0092162 | A1 * | 5/2005 | Whitener | G10H 1/0091 84/625 |
| 2005/0106546 | A1 * | 5/2005 | Strom | G10H 1/0058 434/307 A |
| 2006/0050894 | A1 * | 3/2006 | Boddicker | B60N 3/005 381/77 |
| 2006/0052167 | A1 * | 3/2006 | Boddicker | B60N 3/005 463/37 |
| 2007/0234888 | A1 * | 10/2007 | Rotolo de Moraes | G10H 1/361 84/730 |
| 2009/0022330 | A1 * | 1/2009 | Haulick | H04M 9/082 381/57 |
| 2010/0107856 | A1 * | 5/2010 | Hetherington | G10H 1/366 84/610 |
| 2014/0075306 | A1 * | 3/2014 | Rega | G06F 17/30749 715/716 |

* cited by examiner

CAR KARAOKE

CROSS-REFERENCED TO RELATED APPLICATIONS

This application claims benefit of U.S. Provisional Application No. 62/354,643 filed on Jun. 24, 2016, which the disclosure of which is hereby incorporated by reference in its entirety for all purposes.

FIELD OF THE INVENTION

The disclosure relates to an audio system in a motor vehicle.

BACKGROUND OF THE INVENTION

Car users can get bored during driving, and they may sing alone or with family. While riding in a vehicle, many passengers sing songs, even if there is no music due to only navigation or other non-music related applications playing in the car infotainment unit.

SUMMARY

The present invention may provide a personal experience for a driver or passenger who is singing in a vehicle. In response to a user singing a song, the car infotainment unit automatically plays the background music for the song to accompany the user's singing. The car infotainment unit may retrieve and play music in the form of actual karaoke songs which are available over internet radio. The car infotainment electronic unit may use voice recognition to detect the lyrics that the user is singing, and then may find the song based on the recognized lyrics. The words sung by the user and recognized by the infotainment system may be used to search for a piece of Karaoke music in internet radio applications.

In one embodiment, the invention comprises a motor vehicle including a loudspeaker, a voice recognition module, and a microphone producing a microphone signal based upon words uttered by a human passenger within a passenger compartment of the motor vehicle. An electronic processor is communicatively coupled to the microphone, the loudspeaker, and the voice recognition module. The electronic processor receives the microphone signal and communicates with the voice recognition module to thereby ascertain the words uttered by the human passenger. The electronic processor retrieves Karaoke music corresponding to the ascertained words uttered by the human passenger, and plays the Karaoke music on the loudspeaker.

In another embodiment, the invention comprises a method of providing music within a motor vehicle, including using a microphone to produce a microphone signal based upon words uttered by a human passenger within a passenger compartment of the motor vehicle. A voice recognition module is used to ascertain the words uttered by the human passenger. Karaoke music corresponding to the ascertained words uttered by the human passenger is retrieved. The Karaoke music is played on a loudspeaker associated with the passenger compartment.

In yet another embodiment, the invention comprises a method of providing music within a motor vehicle, including using a microphone to produce a microphone signal based upon utterances by a human passenger within a passenger compartment of the motor vehicle. A voice recognition module is used to determine a tonal pattern of the utterances by the human passenger. Music is created having a melody corresponding to the determined tonal pattern of the utterances by the human passenger. The music is played on a loudspeaker associated with the passenger compartment.

An advantage of the present invention is that it may add music to match the singing of a user. Thus, the invention can provide a personalized user experience and create a cheerful environment for the passengers in the car.

BRIEF DESCRIPTION OF THE DRAWINGS

A better understanding of the present invention will be had upon reference to the following description in conjunction with the accompanying drawings.

DETAILED DESCRIPTION OF THE PREFERRED EMBODIMENTS

Figure 1:
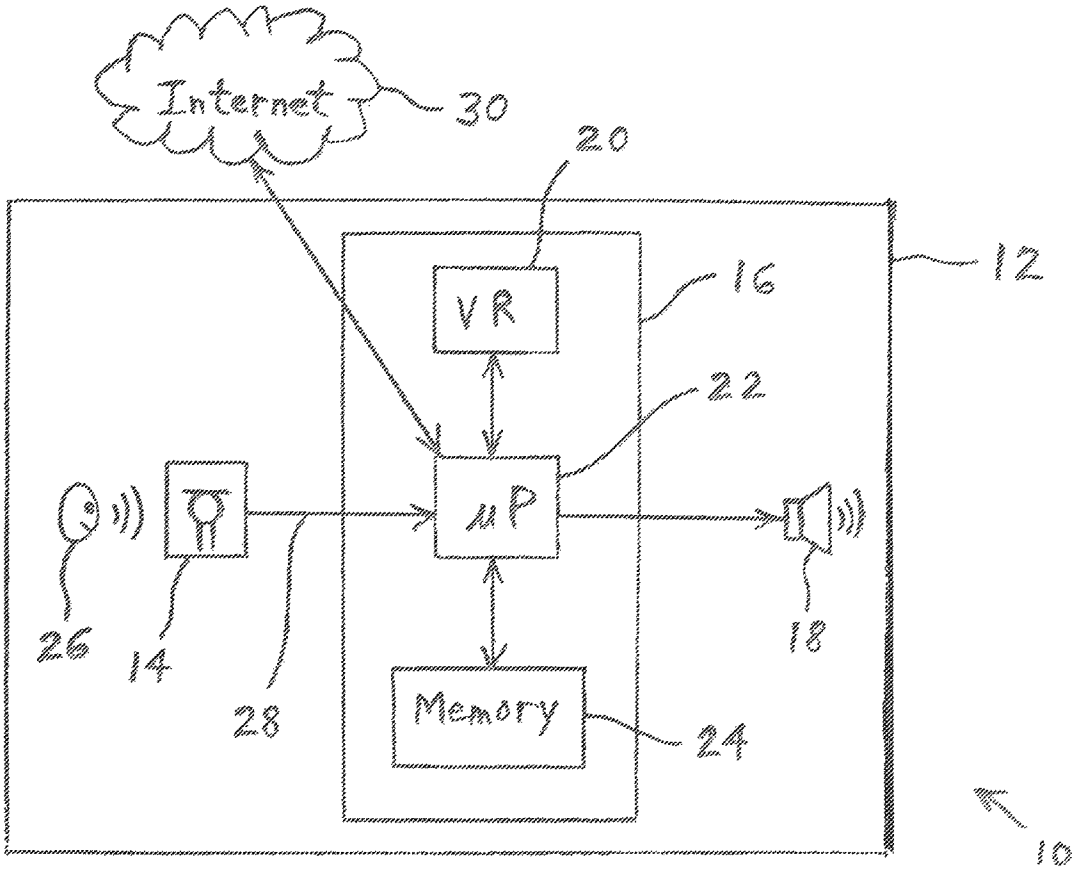
FIG. 1 is a block diagram of one example embodiment of a vehicle audio arrangement of the present invention.

FIG. 1 illustrates a vehicle audio arrangement 10 of the present invention, including a vehicle 12 having a microphone 14, an infotainment system 16 and a loudspeaker 18. Infotainment system 16 includes a voice recognition module 20, an electronic processor 22 and a memory storage device 24.

During use, microphone 14 may pick up the audible singing of a passenger 26 within vehicle 12. Microphone 14 may then transmit a microphone signal 28, based on the passenger's singing, to processor 22. Processor 22 may communicate with voice recognition module 20 in order to ascertain the user's words or lyrics in microphone signal 28. Processor 22 may then perform a search for Karaoke music via the Internet 30, using the user's words or lyrics as a search term. Having received the Karaoke music via the Internet 30, processor 22 may then audibly play the Karaoke music on speaker 18.

In one embodiment, during the searching and retrieving of the Karaoke music, processor 22 continues to use microphone 14 and voice recognition module 20 to keep up with the lyrics that the user is currently singing. Upon receiving the Karaoke music, processor 22 may begin playing the Karaoke music at a point within the music that corresponds with the point within the lyrics at which the user is currently singing. Thus, the user does not have to start singing the song from the beginning of the song when the Karaoke music starts to play.

In another embodiment, the Karaoke music is stored in memory 24, and processor 22 searches for and retrieves the Karaoke music from memory 24 instead of from the Internet 30. In yet another embodiment, the Karaoke music is initially retrieved from the Internet 30, but is stored in memory 24 upon being received by processor 22. Thus, the next time it is detected that the user is singing the same lyrics, processor 22 may more quickly and reliably retrieve the Karaoke music from memory 24 instead of from the Internet 30.

The invention has been described as retrieving music from the Internet, or from in-vehicle storage. In another embodiment, however, the music being played is music created by the head unit of the vehicle's infotainment system itself. The infotainment system may use voice recognition to detect the audio pattern uttered by the user, including changes in the tone of the user's voice. Thereby, the infotainment system may ascertain a melody of the song that the user is singing. The audio pattern recognition can then be used by the system to produce audible tones and a melody to accompany the user's singing.

Although the voice recognition module has been described herein as being disposed in the vehicle, in another embodiment the voice recognition module is disposed remotely from the vehicle, and may be internet-based. The processor may wirelessly communicate with the voice recognition module.

Figure 2:
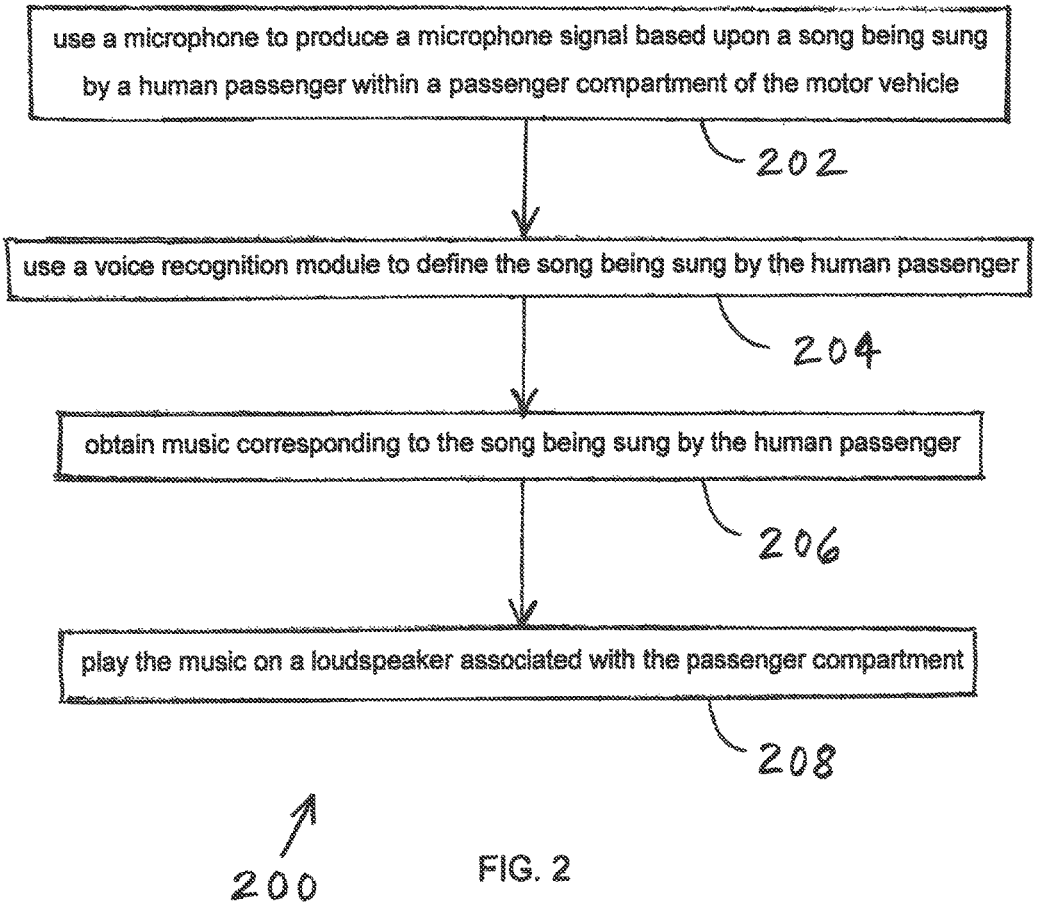
FIG. 2 is a flow chart of one example embodiment of a method of the present invention for providing music within a motor vehicle.

FIG. 2 illustrates one example embodiment of a method 200 of the present invention for providing music within a motor vehicle. In a first step 202, a microphone is used to produce a microphone signal based upon a song being sung by a human passenger within a passenger compartment of the motor vehicle. For example, microphone 14 may detect the sounds of a passenger singing a song, and may produce a microphone signal 28 based on the song.

Next, in step 204, a voice recognition module is used to define the song being sung by the human passenger. For example, voice recognition module 20 may ascertain the lyrics or words uttered by the human passenger while singing the song, or voice recognition module 20 may determine a tonal pattern of the singing by the human passenger.

In a next step 206, music corresponding to the song being sung by the human passenger is obtained. For example, Karaoke music corresponding to the words or lyrics sung by the human passenger may be retrieved from the Internet 30 or memory 24. Alternatively, music having a melody corresponding to the determined tonal pattern of the human passenger's singing may be created by processor 22.

In a final step 208, the music is played on a loudspeaker associated with the passenger compartment. For example, the music may be audibly played on loudspeaker 18 within a passenger compartment of vehicle 12.

The foregoing description may refer to "motor vehicle", "automobile", "automotive", or similar expressions. It is to be understood that these terms are not intended to limit the invention to any particular type of transportation vehicle. Rather, the invention may be applied to any type of transportation vehicle whether traveling by air, water, or ground, such as airplanes, boats, etc.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A motor vehicle, comprising:

a loudspeaker;

a voice recognition module;

a microphone configured to produce a microphone signal based upon lyrics of a song uttered by a human passenger within a passenger compartment of the motor vehicle; and an electronic processor communicatively coupled to the microphone, the loudspeaker, and the voice recognition module, the electronic processor being configured to:

receive the microphone signal and communicate with the voice recognition module to thereby ascertain the lyrics uttered by the human passenger;

retrieve Karaoke music corresponding to the ascertained lyrics uttered by the human passenger;

continue to ascertain the lyrics being uttered by the human passenger while the Karaoke music is being retrieved; and begin playing the Karaoke music on the loudspeaker at a point in the music that corresponds to a point within the song at which the passenger is currently singing.

2. The motor vehicle of claim 1 wherein the Karaoke music is retrieved via the Internet.

3. The motor vehicle of claim 1 further comprising a memory storage device, the Karaoke music being retrieved from the memory storage device.

4. The motor vehicle of claim 1 wherein the processor is configured to retrieve information specifying correspondences between individual words in the lyrics and points within accompanying music.

5. The motor vehicle of claim 1 wherein the Karaoke music includes only instrumental music without any human voice.

6. A method of providing music within a motor vehicle, the method comprising:

using a microphone to produce a microphone signal based upon lyrics of a song uttered by a human passenger within a passenger compartment of the motor vehicle;

using a voice recognition module to ascertain the lyrics uttered by the human passenger;

retrieving Karaoke music corresponding to the ascertained lyrics uttered by the human passenger;

playing the Karaoke music on a loudspeaker associated with the passenger compartment; and continuing to ascertain the lyrics being uttered by the human passenger while the Karaoke music is being retrieved, wherein the playing step includes beginning to play the Karaoke music on the loudspeaker at a point in the music that corresponds to a point at which the passenger is currently singing within the song.

7. The method of claim 6 wherein the Karaoke music is retrieved via the Internet.

8. The method of claim 6 wherein the Karaoke music is retrieved from a memory storage device disposed within the motor vehicle.

9. The method of claim 6 further comprising retrieving information specifying to which point within accompanying music that each individual word in the lyrics corresponds.

10. The method of claim 6 wherein the Karaoke music includes only instrumental music without any human voice.

11. A method of providing music within a motor vehicle, the method comprising:

using a microphone to produce a microphone signal based upon utterances by a human passenger within a passenger compartment of the motor vehicle, the utterances including lyrics of a song;

using a voice recognition module to determine a tonal pattern of the utterances by the human passenger;

creating music having a melody corresponding to the determined tonal pattern of the utterances by the human passenger;

playing the music on a loudspeaker associated with the passenger compartment; and continuing to determine a tonal pattern of the utterances by the human passenger while the Karaoke music is being created, wherein the playing step includes beginning to play the music on the loudspeaker at a point in the music that corresponds to a point at which the passenger is currently singing within the song.

12. The method of claim 11 further comprising retrieving information specifying to which point within accompanying music that each individual word in the lyrics corresponds.

13. The method of claim 11 further comprising:

storing the music in a memory storage device in association with the lyrics;

retrieving the music from the memory storage device in response to determining that the user is again singing the lyrics; and playing the retrieved music to accompany the user singing the lyrics.

14. The method of claim 11 wherein the music includes only instrumental music without any human voice.

* * * * *